US008713983B2

(12) United States Patent
Choi et al.

(10) Patent No.: US 8,713,983 B2
(45) Date of Patent: May 6, 2014

(54) ROLLING MILL AND ROLL THEREOF

(75) Inventors: Chang Hee Choi, Daegu (KR); Kil Sung Kim, Daegu (KR)

(73) Assignee: TaeguTec, Ltd., Dalseong-gun, Daegu (KR)

( * ) Notice: Subject to any disclaimer, the term of this patent is extended or adjusted under 35 U.S.C. 154(b) by 787 days.

(21) Appl. No.: 12/523,352

(22) PCT Filed: Jan. 17, 2007

(86) PCT No.: PCT/KR2007/000282
§ 371 (c)(1),
(2), (4) Date: Jul. 16, 2009

(87) PCT Pub. No.: WO2007/148864
PCT Pub. Date: Dec. 27, 2007

(65) Prior Publication Data
US 2010/0024507 A1 Feb. 4, 2010

(51) Int. Cl.
*B21B 39/20* (2006.01)
*B21B 27/02* (2006.01)

(52) U.S. Cl.
USPC ..... 72/252.5; 492/1; 492/3; 492/33; 492/45

(58) Field of Classification Search
USPC ..... 72/252.5, 237; 492/1, 3, 45, 33, 38, 28, 492/39, 40
See application file for complete search history.

(56) References Cited

U.S. PATENT DOCUMENTS

| | | | | | |
|---|---|---|---|---|---|
| 4,218,907 | A | * | 8/1980 | Ruhl | 72/241.2 |
| 4,615,639 | A | * | 10/1986 | Seireg | 403/356 |
| 5,171,520 | A | * | 12/1992 | Bryan et al. | 376/414 |
| 5,906,130 | A | * | 5/1999 | Sekera et al. | 72/252.5 |
| 6,110,084 | A | | 8/2000 | Kanno et al. | |
| 2008/0016785 | A1 | | 1/2008 | Kukino et al. | |

FOREIGN PATENT DOCUMENTS

| | | | |
|---|---|---|---|
| CN | 2322709 | | 6/1999 |
| CN | 1443608 | | 9/2003 |
| JP | 48-9632 | | 3/1973 |
| JP | 59 010405 | A | 1/1984 |
| JP | 59-021415 | A | 2/1984 |
| JP | 11-033691 | A | 2/1999 |
| JP | 11-277112 | A | 10/1999 |
| JP | 2000-288609 | A | 10/2000 |
| JP | 2001-087806 | A | 4/2001 |
| KR | 201998010310 | U | 5/1998 |
| KR | 200205987 | Y1 * | 12/2000 |

OTHER PUBLICATIONS

Decision on Rejection dated Nov. 30, 2011 issued in Chinese counterpart application No. 200780050016.1.

(Continued)

*Primary Examiner* — Shelley Self
*Assistant Examiner* — Mohammad I Yusuf
(74) *Attorney, Agent, or Firm* — Womble Carlyle

(57) ABSTRACT

A roll coupled to a separately manufactured axle rotates together with the axle in order to perform a rolling process. The roll includes an inner cylindrical surface, an outer cylindrical surface and both side faces, and at least one key way provided on at least one of the side faces is arranged adjacent to the inner cylindrical surface rather than said outer cylindrical surface, The key way is in a concave curved shape and is a portion of a spherical surface or of an ellipsoidal surface.

17 Claims, 11 Drawing Sheets

(56) References Cited

OTHER PUBLICATIONS

International Search Report in PCT/KR2007/000282, dated Oct. 4, 2007.
Office Action in Chinese application No. 200780050016.1, filed Jan. 17, 2007.
Office Action dated Aug. 2, 2011 issued in Japanese counterpart application (No. 2009-546308).
Extended European Search Report dated Mary 7, 2013 issued in European counterpart application (No. 07700999.1).

Chinese patent publication (No. 101657276B) dated Dec. 26, 2012 issued in Chinese counterpart application (No. 2007 850016).

Decision to Grant dated Mar. 19, 2012 issued in Japanese counterpart application No. 2009-546308.

* cited by examiner

ROLLING MILL AND ROLL THEREOF

TECHNICAL FIELD

The present invention generally relates to a roll and a rolling mill, and more particularly to a roll, which is joined to a separately manufactured axle, adapted to rotate together with the axle to perform the rolling operation. Further, the present invention also relates to a rolling mill including said roll.

BACKGROUND ART

Such a roll rotates integrally with an axle that is joined to the roll by means of a key.

Said rolls are illustrated in FIGS. 1 to 3. A key way 2 of the roll 1 extends from one side to the other side thereof.

FIGS. 2 and 3 illustrate the roll 1 assembled with a driving axle 3 under the rolling process. A key 5 is inserted into a cavity defined by the key way 2 of the roll 1 and a key way 4 of the driving axle 3. Thus, the roll 1 rotates integrally with the driving axle 3 to roll a work piece 7.

Reference numerals 6 and 8 denote internal stresses around the key way 2 of the roll 1. As shown in FIG. 2, when the driving axle 3 rotates, the key 5 pushes a front side of the key way 2 to rotate the roll 1 together with the axle 3. Therefore, a compressive stress 6 acts around the front side of the key way 2. As the key 5 approaches the work piece 7, the deformation resistance of the work piece 7 works in a direction of obstructing the movement (i.e., the rotation of the roll) of the key 5, which results in increasing the compressive stress 6 around the front side of the key way 2.

Further, as shown in FIG. 3, when the key way 2 moves away from the work piece 7 by further rotating the roll 1, a tensile stress 8 acts around a rear side of the key way 2, while the compressive stress 6 acts around the front side of the key way 2. Specifically, since a frictional force between the roll 1 and the work piece 7 acts in a direction of obstructing the movement of the key 5, the tensile stress 8 strongly acts around the rear side of the key way 2. Metals with high tensile strength (e.g., steel) are conventionally used for the rolls.

The outer surface of the roll, which contacts the work piece, is subject to compressive and thermal stresses that repeatedly act thereon. When the surface of the roll is worn out due to such stresses or torn off by fatigue cracks, the quality of the rolled surface significantly deteriorates and the rolling process must be stopped for maintenance or repair. To prevent such problems, it is desirable that the roll has high wear/thermal/fatigue resistances.

A cemented tungsten carbide (CTC), including tungsten carbide (WC), has good wear resistance and high temperature mechanical properties. Thus, when a roll made of a tungsten carbide is used, the surface quality of rolled products is improved and the rolling speed is increased, compared to a metallic roll made of carbon steel, etc. Carbide rolls may be used for hot rolling to produce iron rods or bars. Although the carbide rolls have a very strong compressive resistance, they are weak against tensile stresses. Therefore, when a carbide roll and an axle, to which a key structure such as the one shown in FIGS. 1-3 is applied, are used for the rolling process, the carbide roll may be easily broken down by high tensile stresses generated around the key way.

Thus, a carbide roll 11 without any key way is used for the rolling process, as shown in FIG. 4. The carbide roll 11 is axially pressed on both sides with bolts (FIG. 5) or hydraulic devices to transmit a driving force of the driving axle to the roll 11 through the frictional force between the roll 11 and the driving axle. In the case of the carbide roll 11, the driving force is transmitted only through the frictional force between the roll 11 and the driving axle. As such, when a high driving force is applied to the driving axle, slip may occur between the roll 11 and the driving axle, which causes a failure in transmitting the driving force. Therefore, the carbide roll 11 is rarely used in case the driving torque is over 1000 kgf·m.

Japanese Laid-Open Patent Publication No. (Sho) 59-21415 discloses a ceramic roll 21 having key ways on a side face (shown in FIG. 6). The ceramic roll 21 has linear key ways (22) along the diameter on the side face. A metallic driving axle 23 has linear protrusions 24 coupled to the key ways 22. Since the driving force between the ceramic roll 21 and the driving axle 23 is transmitted via the wide contact surface of the key ways 22 and the protrusions 24, an impact force which acts when the roll starts to move is decreased. However, since the key way of the roll 21 extends over the side face along the diameter and ending into a semi-circular concave portion at the outer peripheral surface of the roll 21, the portion of the outer peripheral surface cannot be used for rolling. This increases the size of the roll 21 and manufacturing costs. Furthermore, due to manufacturing tolerances, it may be the case that only a specific pair of the joined key way and the key (among the two pairs of the joined key ways and the keys) mainly makes contacts. This is so that the roll may be easily broken down by an intensive stress on one pair of the key way and the key.

SUMMARY OF THE INVENTION

The present invention is designed to solve such problems of the conventional technique. It is an objective of the present invention to provide a roll having small tensile stress acting around the key way used for coupling the key with the driving axle. It is also an objective of the present invention to provide a rolling mill having such a roll.

It is another objective of the present invention to provide a carbide or ceramic roll, which is capable of transmitting a high rotational torque between the roll and the driving axle, as well as to provide a rolling mill having such a roll.

It is yet another objective of the present invention to provide a roll in which stress is uniformly distributed along the key ways of the roll, wherein said roll has a rolling mill.

The present invention has further objectives as shown in the description presented below.

In order to achieve the above and other objectives, the roll according to the present invention comprises an inner cylindrical surface, an outer cylindrical surface, two side faces, and at least one key way provided on at least one of the side faces. At least one key way is arranged adjacent to the inner cylindrical surface rather than the outer cylindrical surface, and is configured to have a concave curved surface. Preferably, said concave curved surface is a portion of a spherical or ellipsoidal surface.

The roll of the present invention is preferably made of tungsten carbide.

The rolling mill of the present invention comprises a roll, a driving axle, and at least one key for integrally joining said roll and said driving axle. Said roll is in the cylindrical form having an inner cylindrical surface, an outer cylindrical surface and both side faces. At least one key way is provided on at least one of the side faces, wherein said key way is configured to have a concave curved surface, wherein said driving axle has a key way corresponding to the key way of the roll, and wherein said key is received into a cavity defined by the key way of said roll and the key way of said driving axle. The volume of said key is greater than that of said cavity. The hardness of said key is preferably lower than that of the key way surface of the roll.

According to the present invention, the stress uniformly acts around the key way of the roll, particularly the acting tensile stress significantly decreases and the concentrated tensile stress becomes resolved. As a result, the life span, the driving torque in work and the rotating speed of the tungsten carbide or ceramic roll increase, while the surface condition of a rolled product improves.

Moreover, according to the present invention, since a key has less hardness and greater volume than those of the key way of the roll, the key is pressed in the key way of the roll, thereby causing a deformation which allows the key to sufficiently contact the key way. Thus, it may prevent stress from concentrating around a specific part between the key and the key way may be prevented. Further, even if a plurality of keys is used, stress is not concentrated between a particular key and a key way. Rather, stress is uniformly distributed over the plurality of keys and the key way.

DETAILED DESCRIPTION

Figure 7:
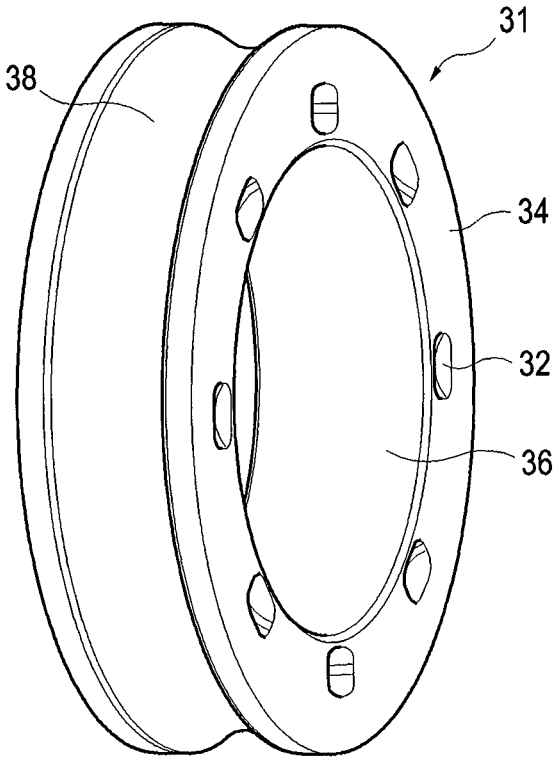
FIG. 7 is a perspective view of the roll according to Embodiment 1 of the present invention.

FIG. 7 illustrates a roll 31 according to Embodiment 1 of the present invention. The roll 31 is in a cylindrical form having an inner cylindrical surface 36, an outer cylindrical surface 38 and both side faces 34. The inner cylindrical surface 36 extends for the length of the roll 31 between the two side faces 34. Said side faces 34 are provided with a plurality of key ways 32 which are spaced apart from the inner cylindrical surface rather than being opened thereto. Said key ways 32 are concavely curved shaped. With regard to the present invention, the expression "concave curved surface" indicates a depressed portion in which any tangential direction of the surface is not drastically changed but rather smoothly and continuously. Preferably, the key way 32 having a concave curved surface is configured to be a portion of a spherical or ellipsoidal surface.

Generally, when a roll is used, the outer cylindrical surface of the roll is re-polished in order to enhance the milling efficiency for repetitive use. The key ways 32 are arranged to be adjacent to the inner cylindrical surface 36 rather than to the outer cylindrical surface 38 of the roll. This is so that the key ways 32 are not exposed onto the outer cylindrical surface 38 of the roll 31 when the roll is re-polished numerous times.

Figure 8:
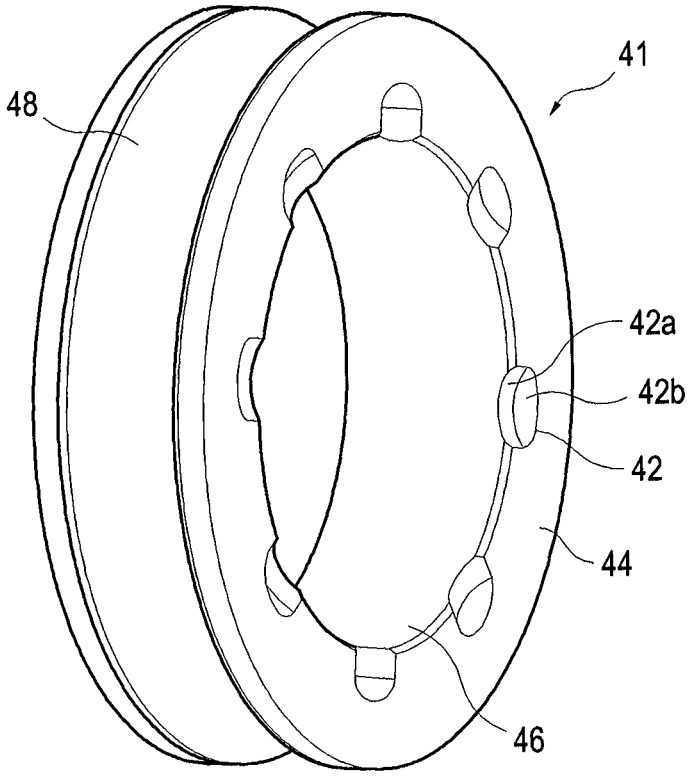
FIG. 8 is a perspective view of the roll according to Embodiment 2 of the present invention.

FIG. 8 illustrates a roll 41 according to Embodiment 2 of the present invention. In the roll 41 according to Embodiment 2 of the present invention, the key way 42 is formed in an open shape toward the inner cylindrical surface 46 of the roll 41. The key way 42 comprises a first portion 42*a* opened toward the inner cylindrical surface 46 of the roll 41, and a second portion 42*b* consecutively arranged on the outer cylindrical surface in the radius direction of said first portion 42*a*. Thus, the first portion 42*a* of the key way 42 is formed at only the intersection between the side face 44 and the inner cylindrical surface 46. The cross-sectional view of the key way 42 along the tangential direction of the inner cylindrical surface 46 of the roll 41 is a portion of a spherical or ellipsoidal surface.

Figure 9:
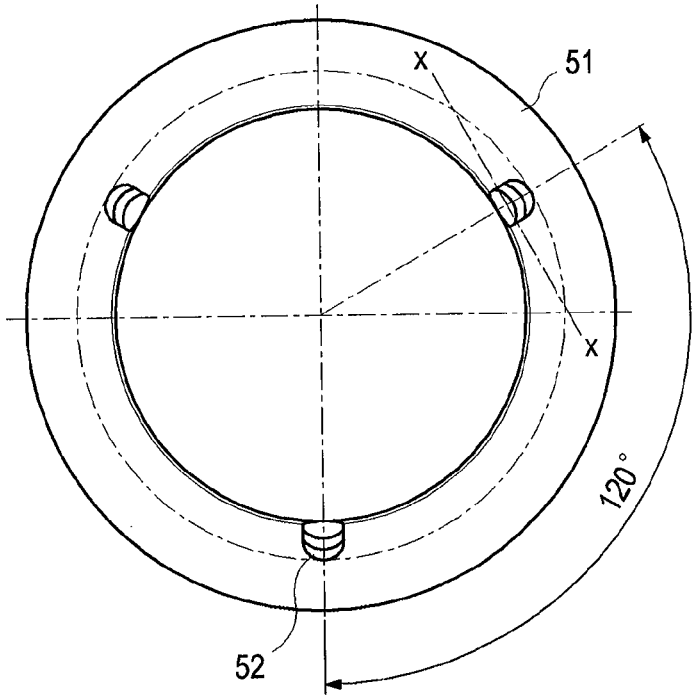
FIG. 9 is a side view of the roll according to Embodiment 3 of the present invention.

FIG. 9 illustrates a roll 51 according to Embodiment 3 of the present invention. The roll 51 is provided with three key ways 52 on one side. Said three key ways 52 are arranged with a predetermined angle (120°) from one another. The number of the key ways of the roll may vary, depending on the amount of driving torque.

Figure 10:
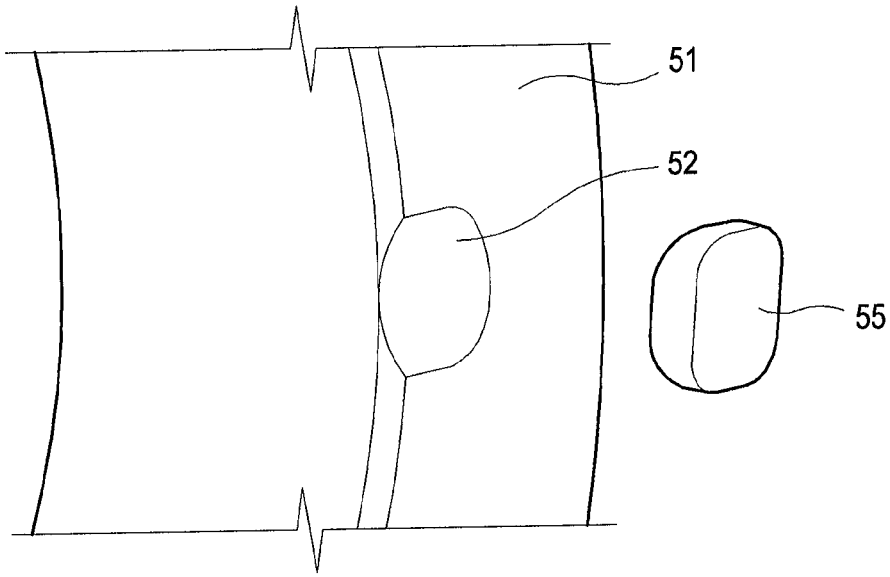
FIG. 10 is a partially enlarged view of the roll of FIG. 9 along with a key.

FIG. 10 is a partially enlarged view of the roll 51, together with a key, according to the present invention. A key 55 fits into the key way 52 of the roll 51. The key 55 consists of a portion to be inserted into the key way 52 of the roll 51 and a portion to be inserted into the key way 54 (shown in FIG. 3) of the driving axle. The portion to be inserted into the key way 52 is slightly greater than the key way 52, and is in a shape corresponding to that of the concave portion of the key way 52. Preferably, the shape of the key 55 corresponding to the concave portion of the key way 52 must be similar as possible to the shape of the concave portion of the key way 52.

Figure 11:
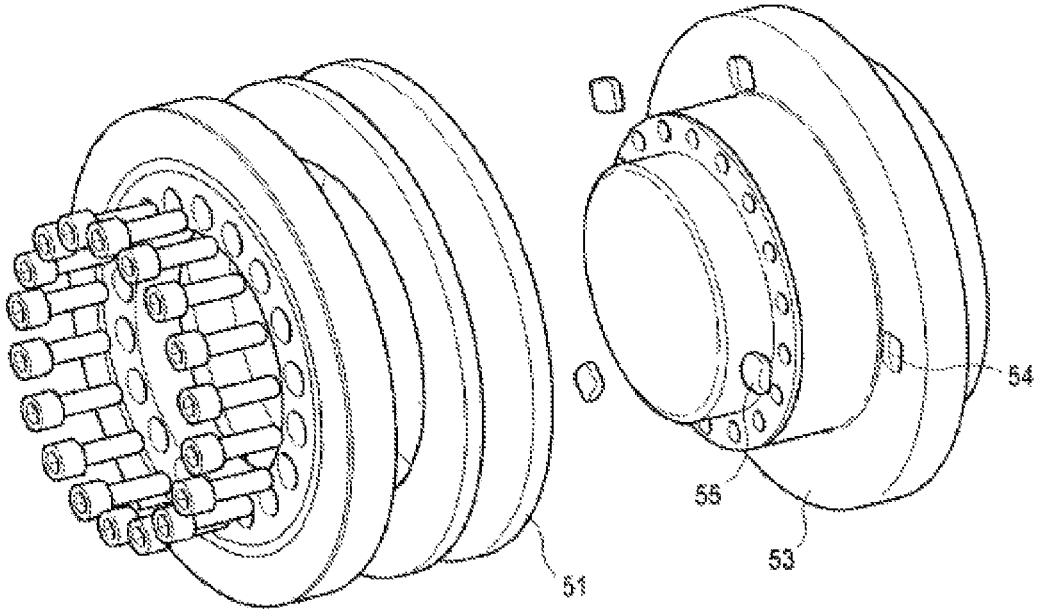
FIG. 11 is an exploded view of a rolling mill with the roll of FIG. 9, a plurality of keys and a driving axle.

FIG. 11 is an exploded view of a rolling mill comprising a roll 51 of FIG. 9, along with a plurality of keys 55 and a driving axle 53. The driving axle 53 is also provided with three key ways 54 on one side. The key 55 is received in a cavity defined by the key way 52 of said roll 51 and the key way 54 of said driving axle 53. The volume of said key 55 is greater than that of said cavity. A portion of the key 55 protruding from the key way 52 of the roll 51 is inserted into the key way 54 of the driving axle 53.

The key 55 has a lower hardness than that of the key way 52 of the roll 51. Since the hardness of the key 55 is lower than that of the roll 51, the key 55 properly deforms in accordance with the shape of the key way 52 when the key 55 is pressed to be joined in the key way 52 and then fills in the key way 52. Thus, even when the rotation torque is transmitted between the driving axle 53 and the roll 51, the key 55 maintains the entire contact with the key way 52 (not being tilted toward one side in the key way 52). Thus, the driving axle 53 can work integrally with the roll 51. Further, the stress generated during the rolling process is uniformly distributed among every key and key way. In this way, stress may be prevented from concentrating between a certain key and its corresponding key way, or at a certain portion between a key and its corresponding key way.

Preferably, the hardness of the key 55 may not exceed HRC 40. If the hardness of the key exceeds HRC 40, then it is difficult for the key 55 to deform in the key way 52 of the roll 51. Thus, it is hard to provide the result of preventing stress concentration since the contact area between the key 55 and the key way 52 cannot increase.

Figure 12:
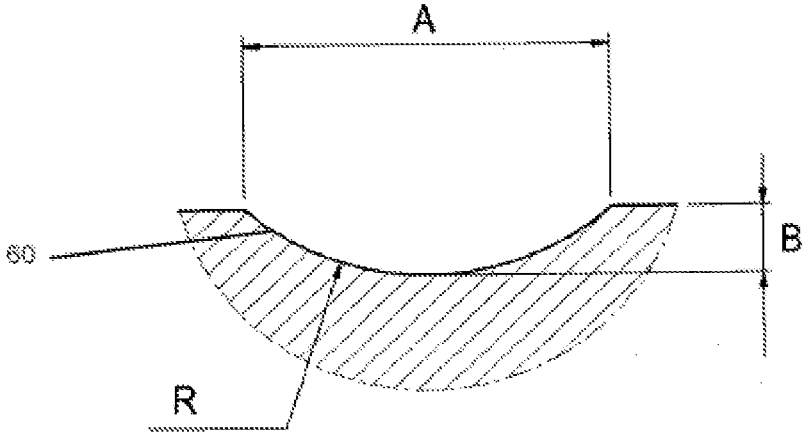
FIG. 12 is a sectional view of a key way in a tangential direction of the inner peripheral surface of the roll of the present invention.
Figure 13:
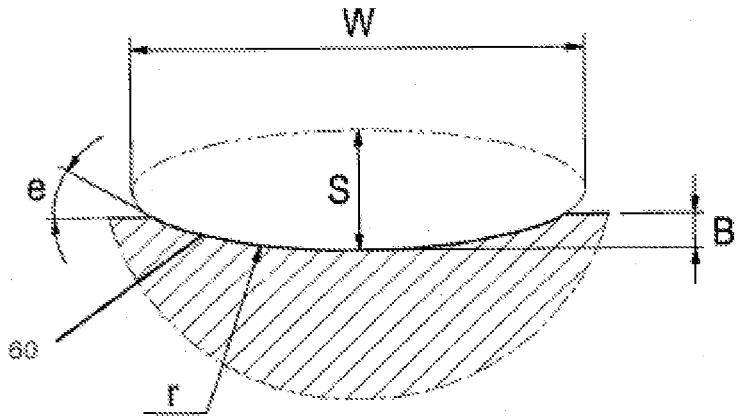
FIG. 13 is a sectional view of another key way in a tangential direction of the inner peripheral surface of the roll of the present invention.

FIGS. 12 and 13 illustrate cross-sectional views wherein the key way of the roll according to the present invention is cut in the tangential direction (line X-X) of the inner cylindrical surface of the roll as seen in FIG. 9. FIG. 12 illustrates the cross-sectional view of the key way in a spherical form. Said key way can be defined to have a width (A), a depth (B) and a concave curved bottom surface 60 having a radius of curvature (R). Preferably, the width (A) of the key way 42 ranges from 12 to 36 mm, the depth (B) ranges from 2 to 6 mm and the radius of curvature (R) ranges from 10 to 30 mm. More preferably, the width (A) of the key way 42 is 21 mm, the depth (B) is 3 mm and the radius of curvature (R) is 20 mm. Thus, as illustrated by the cross-sectional views of FIGS. 12 and 13, the key way constitutes a blind hole having a concave curved bottom surface 60.

As illustrated in FIG. 13, the cross-section of the key way of the roll according to the present invention may be a portion of an ellipsoidal shape. Said key way can be defined to have a major width (W), a short width (S) and a depth (d). Preferably, the major width (W) ranges from 15 to 45 mm, the short width (S) ranges from 5 to 20 mm, and the depth (d) ranges from 2 to 6 mm. For instance, the major width (W) of the key way 52 is 28 mm, the short width (S) is 11 mm and the depth (d) is 3 mm. The key way 52 has various lengths of the radius of curvature (r) ranging from 11 to 36 mm, depending on the position on the curvature surface.

Figure 1:
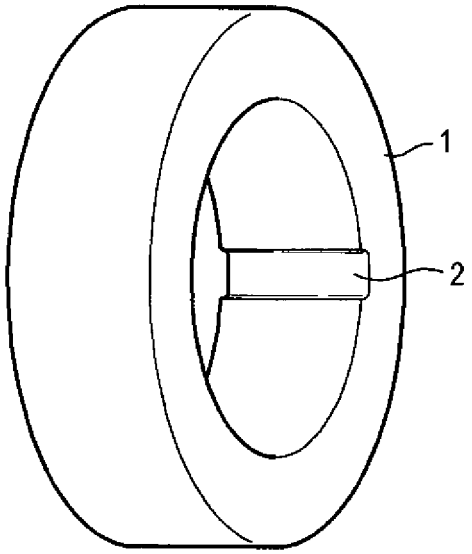
Figure 1 (Prior Art)
FIG. 1 is a perspective view of a conventional roll.
Figure 2:
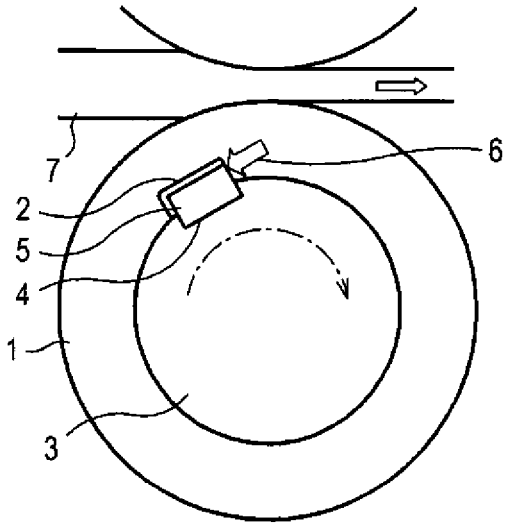
Figure 2 (Prior Art)
FIG. 2 is the roll of FIG. 1 under operation.
Figure 3:
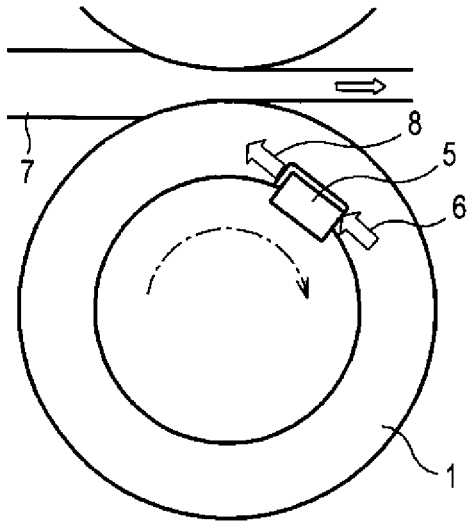
Figure 3 (Prior Art)
FIG. 3 is the milling roll under operation, illustrating the state wherein the key position has been forwarded from that shown in FIG. 2.
Figure 4:
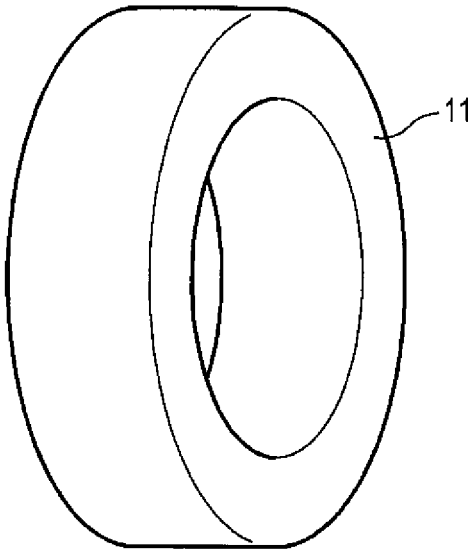
Figure 4 (Prior Art)
FIG. 4 is a perspective view of a conventional tungsten carbide roll.
Figure 5:
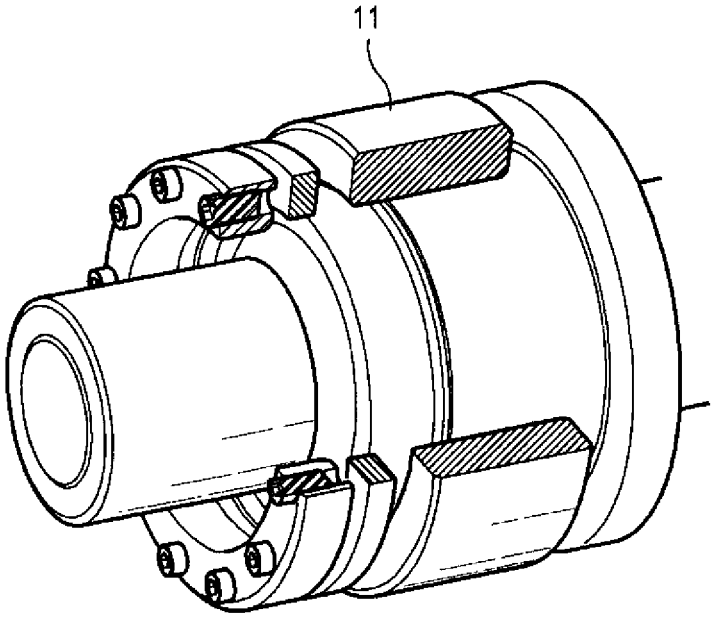
Figure 5 (Prior Art)
FIG. 5 is a perspective view of an axial compression device for the tungsten carbide roll of FIG. 4.
Figure 6:
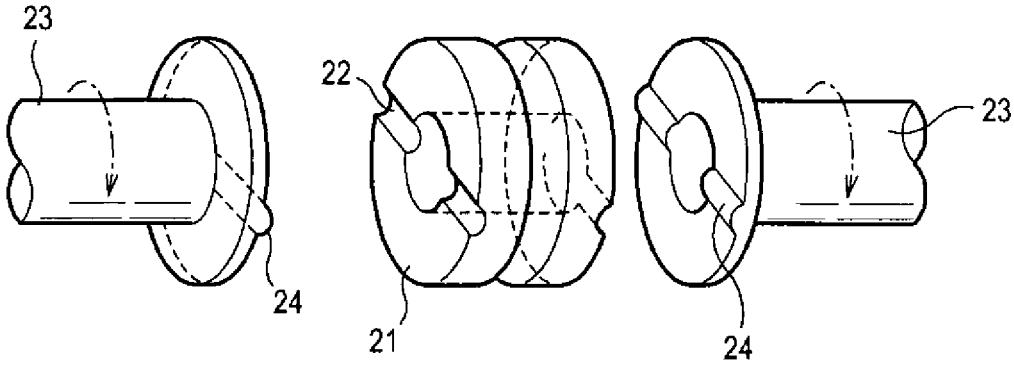
Figure 6 (Prior Art)
FIG. 6 is a perspective view of another conventional ceramic roll.

The inventor of the present invention confirmed that the key way according to the present invention significantly improves the stress distribution when the key is positioned at the position of FIG. 3 during the rolling process, compared to other shapes of key ways in conventional rolls. FIGS. 14 to 19 illustrate views of each shape and tensile stress distribution of the miniature roll with the key way shape according to the present invention as well as other key way shapes. Each of the stress distributions is measured under the condition in which only the key way has a different shape but all other factors such as the size and material of the roll, the driving torque of the driving axle, etc. are the same. All the numerical values of the stress shown in FIGS. 14 to 19 indicate only relative values.

Figure 14:
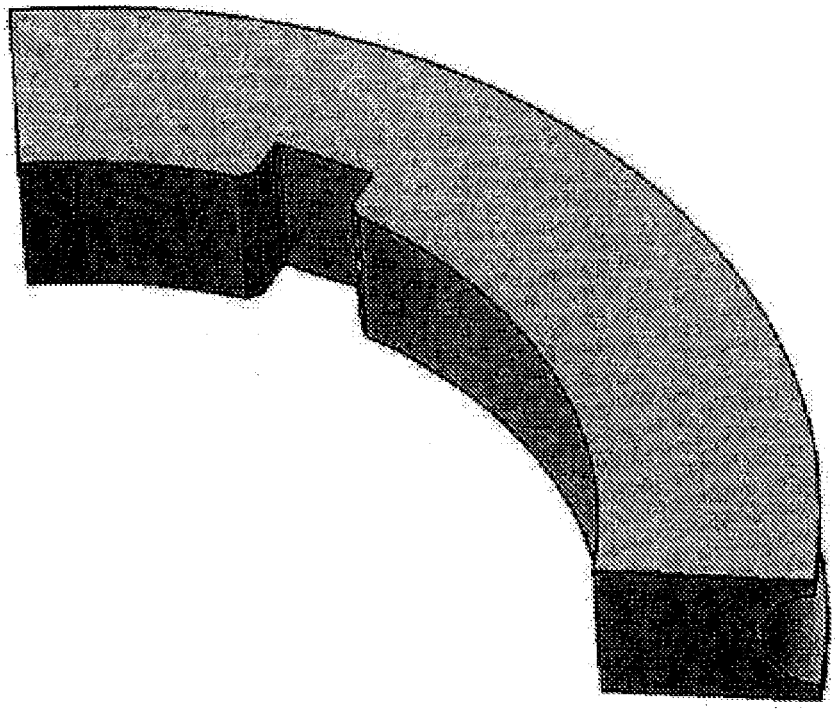
FIG. 14 is a partially enlarged view of the roll of FIG. 1
Figure 15:
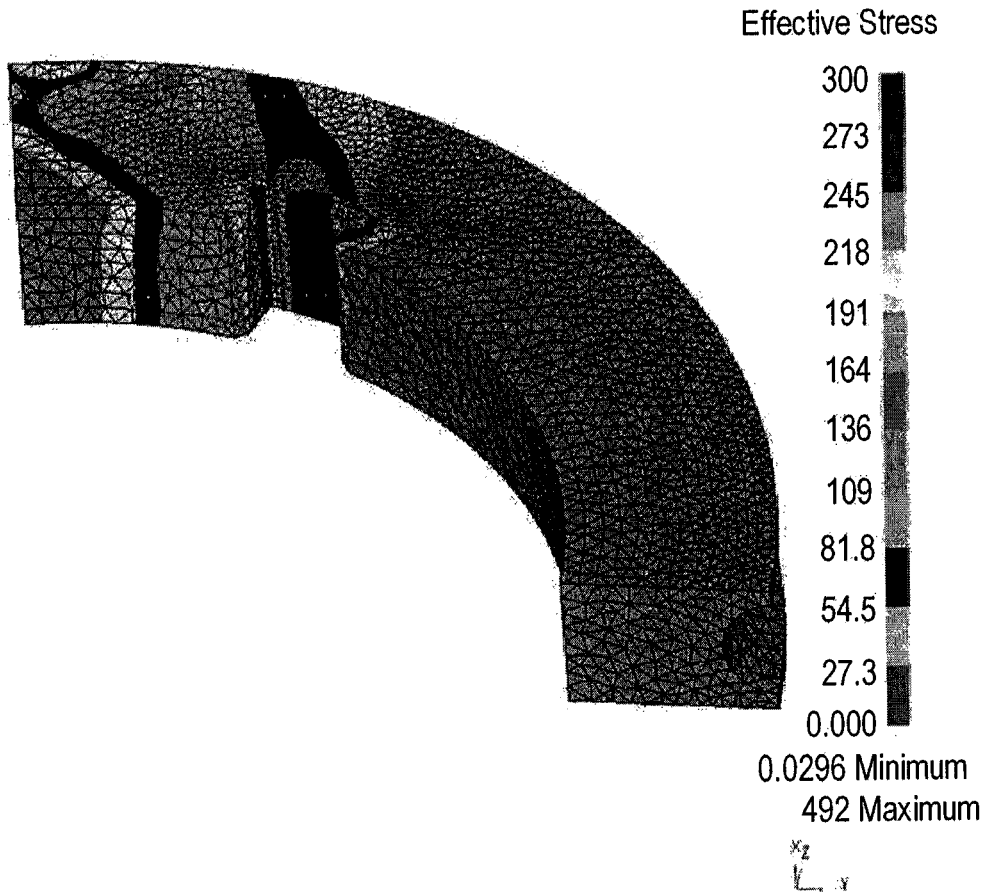
FIG. 15 is a diagram of stress distribution in the roll of FIG. 14.

FIG. 14 illustrates the key way shape of a conventional roll. FIG. 15 illustrates the stress distribution acting around the key way of the roll of FIG. 14. As illustrated in FIG. 15, a portion indicating a tensile stress over 300 Mpa, due to the concentration of the tensile stress, is widely distributed over the side face of the rear of the key way.

Figure 16:
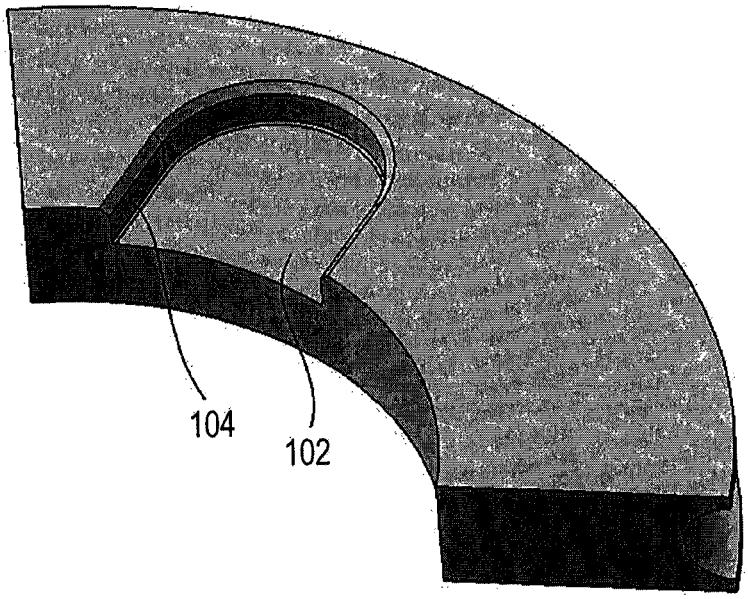
FIG. 16 is a partially enlarged view of a roll with a concaved cylindrical key way.
Figure 17:
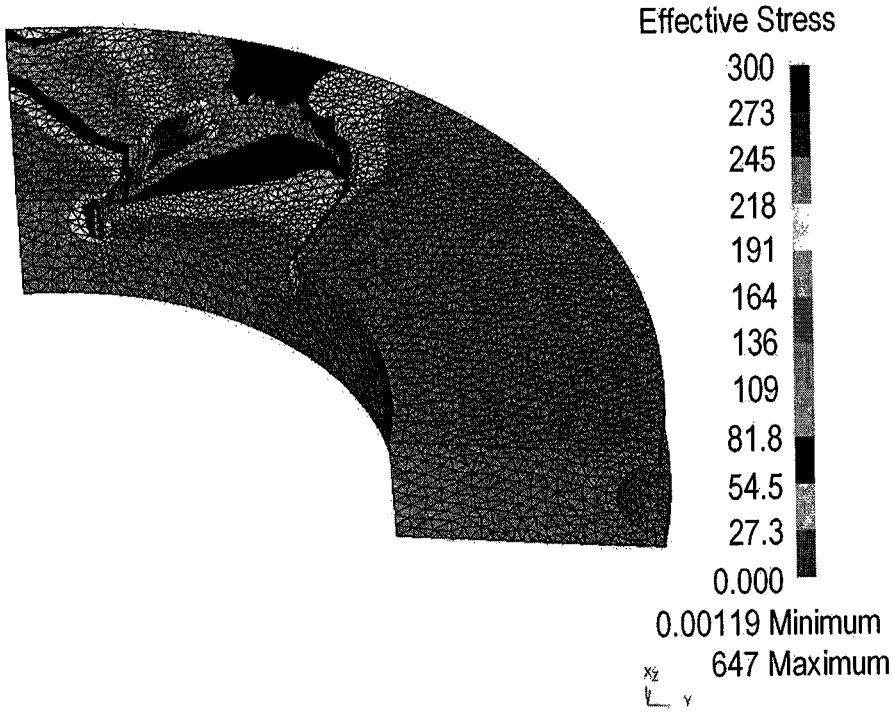
FIG. 17 is a diagram of stress distribution in the roll of FIG. 16.

FIG. 16 illustrates a roll comprising a key way having a flat lower surface portion 102 and a side portion 104 perpendicular to the lower surface portion 102. FIG. 17 illustrates the stress distribution acting around the key way of the roll of FIG. 16. As illustrated in FIG. 17, a portion indicating a tensile stress over 300 Mpa due to the concentration of the tensile stress is widely distributed over the side surface 104 of the rear of the key way.

Figure 18:
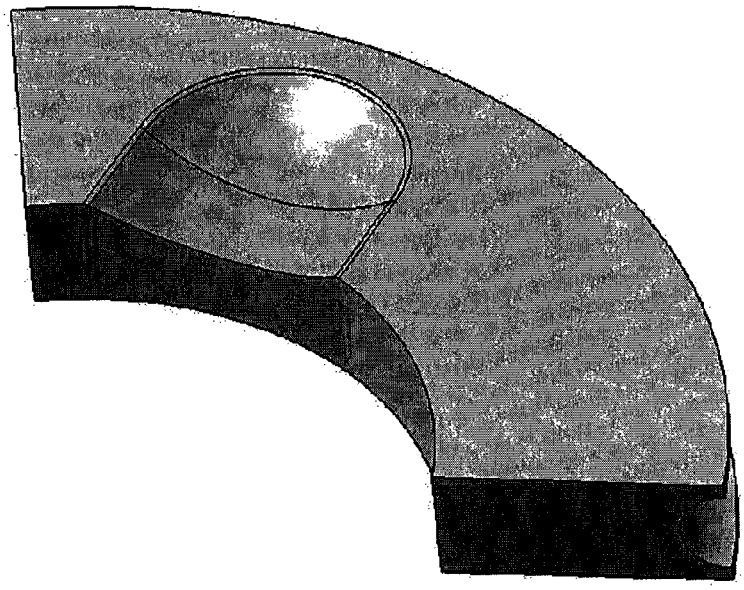
FIG. 18 is a partially enlarged view of a roll according to Embodiment 2 of the present invention.
Figure 19:
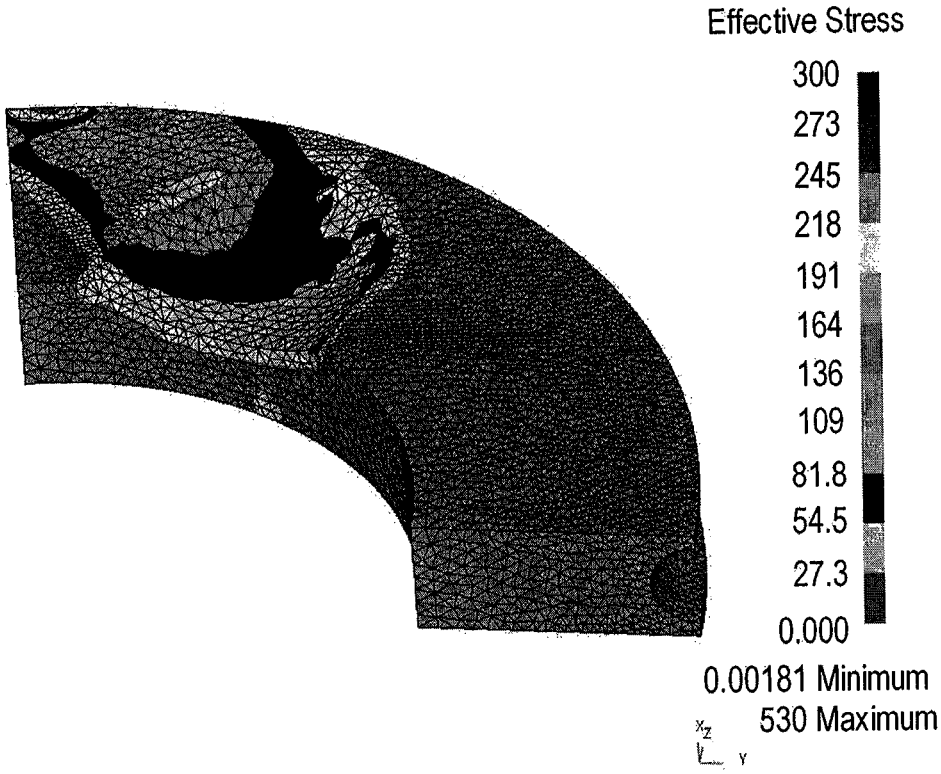
FIG. 19 is a diagram of stress distribution of the roll of FIG. 18.

FIG. 18 illustrates a roll according to Embodiment 2 of the present invention. FIG. 19 illustrates the distribution of the stress acting around the key way of the roll illustrated in FIG. 18. As shown in FIG. 19, according to the present invention, there is no portion where the tensile stress excessively concentrates, and that the stress is overall uniformly distributed. In particular, the present invention significantly reduces the tensile stress acting around the key way, and thus, it can be easily applied to a tungsten carbide or ceramic roll.

The present invention has been described in reference to the embodiments shown in the attached drawings. However, the embodiments are only limited to examples, and thus, the present invention may be practiced in various ways.

The invention claimed is:

1. A roll suitable for roll forming sheet metal in a rolling mill, comprising:

a 360 degree inner cylindrical surface;

a 360 degree outer cylindrical surface; and two side faces; and a plurality of circumferentially spaced apart key ways provided on at least one of the side faces, the plurality of circumferentially spaced apart key ways being arranged closer to the inner cylindrical surface than to the outer cylindrical surface, wherein:

the inner cylindrical surface extends for the length of the roll between the two side faces;

each of the key ways is spaced apart from the inner cylindrical surface; and each of the key ways is formed as a blind hole having a concave curved bottom surface.

2. The roll of claim 1, wherein the roll is made of tungsten carbide.

3. The roll of claim 1, wherein the concave curved surface is a portion of a spherical surface.

4. The roll of claim 3, wherein the key way has a width of 12 to 36 mm, a depth of 2 to 6 mm, and a curvature radius of 10 to 30 mm.

5. The roll of claim 1, wherein the concave curved surface is a portion of an ellipsoidal surface.

6. The roll of claim 5, wherein the key way has a major width of 15 to 45 mm and a depth of 2 to 6 mm.

7. A rolling mill for roll forming sheet metal, comprising:

a roll suitable for roll forming sheet metal, comprising:

a 360 degree inner cylindrical surface;

a 360 degree outer cylindrical surface;

two side faces; and a plurality of circumferentially spaced apart key ways provided on at least one of the side faces, the plurality of circumferentially spaced apart key ways being arranged closer to the inner cylindrical surface than to the outer cylindrical surface;

a driving axle having at least one key way corresponding to at least one of the plurality of circumferentially spaced apart key ways of the roll; and a plurality of keys integrally coupling the roll and the driving axle, wherein:

each key is received into a cavity defined by at least one of the plurality of circumferentially spaced apart key ways of the roll and the key way of the driving axle, and the volume of the key is greater than that of the cavity;

the inner cylindrical surface extends for the length of the roll between the two side faces;

wherein each of the key ways is spaced apart from the inner cylindrical surface; and each of the key ways is formed as a blind hole having a concave curved bottom surface.

8. The rolling mill of claim 7, wherein the hardness of each key is lower than that of the key way surface of the roll.

9. The rolling mill of claim 8, wherein the roll is made of tungsten carbide and the hardness of each key is no more than HRC 40.

10. The rolling mill of claim 7, wherein:

the roll and the driving axle each are provided with a plurality of keyways;

the keyways are circumferentially evenly spaced apart from one another; and each key has a first portion inserted into the key way of the roll, and a second portion inserted into the key way of the driving axle.

11. A rolling mill for roll forming sheet metal, comprising:

a roll suitable for roll forming sheet metal, comprising:

a 360 degree inner cylindrical surface;

a 360 degree outer cylindrical surface;

two side faces; and a plurality of circumferentially spaced apart key ways provided on at least one of the side faces, the plurality of circumferentially spaced apart key ways being arranged closer to the inner cylindrical surface than to the outer cylindrical surface and being configured to have a concave curved surface;

a driving axle having a plurality of key ways corresponding to the plurality of circumferentially spaced apart key ways of the roll; and a plurality of keys integrally coupling the roll and the driving axle, wherein:

each key is received into a cavity defined by one of the plurality of circumferentially spaced apart key ways of the roll and one of the plurality of key ways of the driving axle, and the volume of the key is greater than that of the cavity;

the inner cylindrical surface extends for the length of the roll between the two side faces;

the keyways are circumferentially evenly spaced apart from one another;

each key has a first portion inserted into the key way of the roll, and a second portion inserted into the key way of the driving axle;

the roll is made of tungsten carbide;

the hardness of the keys is lower than that of the corresponding key way surface of the roll;

the hardness of the keys is no more than HRC 40 so that the first portion of each key deforms in a corresponding key way of the roll.

12. The rolling mill of claim 11, wherein:

the concave curved surface is a portion of a spherical surface; and each key way formed in the roll has a width of 12 to 36 mm, a depth of 2 to 6 mm, and a curvature radius of 10 to 30 mm.

13. The rolling mill of claim 11, wherein:

the concave curved surface is a portion of an ellipsoidal surface; and each key way formed in the roll has a major width of 15 to 45 mm, a short width of 5 to 20 mm and a depth of 2 to 6 mm.

14. A rolling mill for roll forming sheet metal, comprising:

a roll suitable for roll forming sheet metal, comprising:

a 360 degree inner cylindrical surface;

a 360 degree outer cylindrical surface;

two side faces; and a plurality of circumferentially spaced apart key ways provided on the two side faces, each key way comprising a first portion opened toward the inner cylindrical surface and a second portion merging with the first portion, each key way having a key way surface;

wherein a cross-sectional view of each key way along the tangential direction of the inner cylindrical surface is a concave curved surface forming a portion of a spherical or ellipsoidal surface, the first portion of the key way being formed at only an intersection between the side face and the inner cylindrical surface;

a driving axle provided with a plurality of circumferentially spaced apart key ways opposing the key ways of the roll and defining cavities therebetween;

a key received into each cavity, each key having a portion inserted into the key way of the roll and a portion inserted into the key way of the driving axle, wherein:

the portion of the key inserted into the key way of the roll has a shape corresponding to a shape of the key way of the roll; and the key deforms in accordance with the shape of the key way of the roll, when the key is pressed to be joined in the key way of the roll.

15. The rolling mill of claim 14, wherein:

the roll is made of tungsten carbide;

the hardness of the keys is lower than that of the corresponding key way surface of the roll; and the hardness of the keys is no more than HRC 40 so that the first portion of each key deforms in a corresponding key way of the roll.

16. The rolling mill of claim 14, wherein:

the concave curved surface is a portion of a spherical surface; and each key way formed in the roll has a width of 12 to 36 mm, a depth of 2 to 6 mm, and a curvature radius of 10 to 30 mm.

17. The rolling mill of claim 14, wherein:

the concave curved surface is a portion of an ellipsoidal surface; and each key way formed in the roll has a major width of 15 to 45 mm, a short width of 5 to 20 mm and a depth of 2 to 6 mm.

* * * * *